US007981008B1

(12) United States Patent
Sener et al.

(10) Patent No.: US 7,981,008 B1
(45) Date of Patent: Jul. 19, 2011

(54) STILT SYSTEM

(75) Inventors: James T. Sener, Glastonbury, CT (US); David Mathieu, Colchester, CT (US); Christopher D. Hageman, South Glastonbury, CT (US); Jack D. Murders, West Fork, AR (US)

(73) Assignee: Marshalltown Company, Marshalltown, IA (US)

( * ) Notice: Subject to any disclaimer, the term of this patent is extended or adjusted under 35 U.S.C. 154(b) by 0 days.

(21) Appl. No.: 12/660,317

(22) Filed: Feb. 24, 2010

Related U.S. Application Data

(63) Continuation-in-part of application No. 11/470,092, filed on Sep. 5, 2006, now abandoned.

(51) Int. Cl.
*A63B 25/00* (2006.01)

(52) U.S. Cl. ..... 482/75; 623/28

(58) Field of Classification Search ..... 482/75–78, 482/79, 80; 623/28; 36/34 R, 40–42; 135/66, 135/67
See application file for complete search history.

(56) References Cited

U.S. PATENT DOCUMENTS

| | | | | |
|---|---|---|---|---|
| 76,465 | A | 4/1868 | Jordan | 280/11.12 |
| 241,226 | A | 5/1881 | Landis | 623/28 |
| 406,328 | A | 7/1889 | Yagn | 482/77 |
| 438,830 | A | 10/1890 | Yagn | 482/77 |
| 1,613,535 | A | 1/1927 | Root | 623/28 |
| 2,351,145 | A | 6/1944 | Pearson | 623/28 |
| 2,679,116 | A | 5/1954 | Lyman | 434/250 |
| 3,058,120 | A | 10/1962 | Smith et al. | 623/28 |
| 3,102,272 | A | 9/1963 | Emmert | 623/28 |
| 3,346,882 | A | 10/1967 | Wilhoyte | 623/28 |
| 3,626,519 | A | 12/1971 | Baker | 623/28 |
| 3,902,199 | A | 9/1975 | Emmert | 3/4 |
| 4,185,936 | A | 1/1980 | Takahashi | 403/104 |
| 4,632,371 | A * | 12/1986 | Wirges et al. | 267/64.28 |
| 4,927,137 | A | 5/1990 | Speer | 272/70.1 |
| 5,295,932 | A * | 3/1994 | Rowan | 482/76 |
| 5,645,515 | A | 7/1997 | Armstrong et al. | 482/75 |
| 6,032,914 | A * | 3/2000 | Bastida | 248/354.1 |
| 6,517,586 | B2 * | 2/2003 | Lin | 623/28 |
| 6,666,796 | B1 * | 12/2003 | MacCready, Jr. | 482/51 |
| 7,108,640 | B2 * | 9/2006 | Emmert | 482/75 |
| 2007/0167296 | A1 * | 7/2007 | Hika | 482/76 |

* cited by examiner

*Primary Examiner* — Loan Thanh
*Assistant Examiner* — Daniel F Roland
(74) *Attorney, Agent, or Firm* — Keisling & Pieper PLC; Meredith K. Lowry

(57) ABSTRACT

An industrial stilt generally includes a floor-engaging member having a heel portion and a toe portion, a load-bearing riser pivotally coupled with the heel portion of the floor-engaging member, a biasing assembly pivotally coupled with and between the toe portion of the floor-engaging member and the load-bearing riser, a foot-engaging member, a leg support assembly, and a leg cuff assembly. The biasing assembly assists in preventing excessive forward or backward leans and maintains the load-bearing riser and the user in a substantially vertical, upright position. The position of the leg cuff assembly on the user's leg and the user's elevation may be easily and safely adjusted using bracket and load-bearing riser adjustment and locking assemblies. Foot-engaging member is provided with multiple securing straps and ratchet buckle assemblies to permit secure and adjustable attachment of the stilt to the user's foot, and leg cuff assembly is provided with a strap, ratchet assembly, and cuff pad to enhance adjustment and user comfort.

16 Claims, 5 Drawing Sheets

STILT SYSTEM

CROSS-REFERENCE TO RELATED APPLICATIONS

This application claims priority to and is a continuation-in-part of U.S. application Ser. No. 11/470,092, filed Sep. 5, 2006, now abandoned which is hereby incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

The present invention relates to a device used to elevate the user thereof. In particular, the invention relates to a stilt for temporarily elevating a user to perform a function that requires additional height, while also permitting freedom of movement.

For example, when performing various types of construction and home-improvement projects, it is often necessary to perform tasks at elevated heights. Such tasks include, among others, painting, plastering, installing suspended or sheetrock ceilings, and accessing or installing electrical, heating, ventilation, and air conditioning systems and components. Many of these tasks are made easier when the craftsman is able to work at a vertically elevated height without being restricted in movement due to the use of scaffolds, ladders or other stationary elevated devices.

To obtain convenient, mobile elevation, craftsmen have frequent used conventional stilt devices and systems. Such conventional devices and systems are widely known in the art. Two such devices are disclosed in U.S. Pat. No. 5,645,515 to Armstrong and U.S. Pat. No. 3,902,199 to Emmert. The Armstrong and Emmert stilts are conventional "parallelogram" type stilts comprising a pair of vertical support members pivotally attached between a floor platform and a shoe platform, such that the vertical support members and the floor and shoe platforms are maintained in a substantially parallelogram configuration.

Another such device is shown in U.S. Pat. No. 4,927,137 to Speer. The Speer stilt includes a floor-engaging assembly and a foot support assembly coupled by single pivot connections with an elongated support assembly. Spring and turnbuckle assemblies are coupled between the foot support assembly and floor-engaging assembly and tend to bias the foot support assembly and floor-engaging assembly such that the assemblies are maintained in a generally parallel relationship.

However, these prior art stilt systems and others like them suffer from a number of deficiencies. For example, the prior art systems are generally heavy and unwieldy due to their use of dual vertical support members and the relatively large number of metal parts, resulting in diminished user agility, mobility, and versatility. The dual vertical support members further fail to provide a stilt having a natural walking action as the dual vertical support members require pivot points at the base of both vertical support members. Since humans are accustomed to using the ankle as a pivot with the toes in conjunction with the ball of the foot to counteract the force of the body moving forward and backward, the pivot points shown in the prior art are unnatural to the normal gait of a human. Thus, there is a need in the art to provide a stilt system which mimics the movement of the pivot of the human ankle.

In addition, the prior art systems fail to provide for quick and convenient adjustment of user height and leg cuff position. Finally, the prior art systems lack the ergonomic comforts necessary to improve a user's ability to engage in prolonged usage without fatigue.

Accordingly, there remains a need for a stilt system that is relatively lightweight and enhances user agility and mobility, that is ergonomically designed to enhance user comfort and extend viable usage periods, and that allows the user to quickly and conveniently adjust his or her desired working elevation. The present invention satisfies these and other needs.

SUMMARY OF THE INVENTION

In order to overcome the above-stated problems and limitations, and others, and to achieve the noted objects, there is provided a lightweight and ergonomically-designed industrial stilt system.

In general, the industrial stilt of the present invention comprises a floor-engaging member, a foot-engaging member, a load-bearing riser, a leg support member, and a leg/calf cuff assembly. The floor-engaging member may be fitted with a treaded outsole of relatively soft, pliable material to provide for better traction between the floor-engaging member and the floor or ground. A load-bearing riser is pivotally coupled to a heel portion of the floor-engaging member. The load-bearing riser is rigid, generally tubular, oval-shaped, or D-shaped in cross-section, and includes an upper riser portion received in and in telescoping relation with a lower, fixed riser portion. The overall height/length of the load-bearing riser (and therefore the height of the foot-engaging member and user above the floor or ground) may be adjusted via a locking assembly coupled with the lower, fixed portion of the riser and notches formed in the telescoping upper portion of the load-bearing riser.

The load-bearing riser also is pivotally connected to the toe portion of the floor-engaging member by biasing means pivotally coupled with and between the load-bearing riser and the toe portion of the floor-engaging member. In one embodiment, the biasing means comprises an adjustable tensile spring and an adjustable compression piston in coaxial combination. The tensile spring resists backward lean of the load-bearing riser and the compression piston resists forward lean of the load-bearing riser. The tensile spring and compression piston also function to urge the load-bearing riser to a generally vertical orientation (substantially perpendicular to the surface of the floor or ground) to thereby enhance user safety and comfort.

The foot-engaging member of the present invention also comprises adjustable ratchet-type strap and buckle assemblies generally positioned at or near the user's toe, arch, and heel to releasably couple the user's foot to the foot-engaging member of the stilt while in use. A leg support member is adjustably coupled to an outer portion of the foot-engaging member via a leg support member adjustment bracket. A leg/calf cuff assembly having interior padding and an adjustable ratchet-type strap and buckle assembly is fixed to the upper portion of the leg support member to provide additional stability and safety to the user when the leg/calf cuff assembly is releasably coupled to the user's leg. The leg support member is received in the leg support member adjustment bracket, and the bracket may be temporarily loosened to enable the user to raise or lower the leg/calf cuff assembly and adjust the position of the leg/calf cuff on the user's calf or lower leg, thereby enhancing the user's comfort safety.

Further objects, features, and advantages of the present invention over the prior art will become apparent from the detailed description of the drawings which follows, when considered with the attached figures.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION OF THE INVENTION

Figure 1:
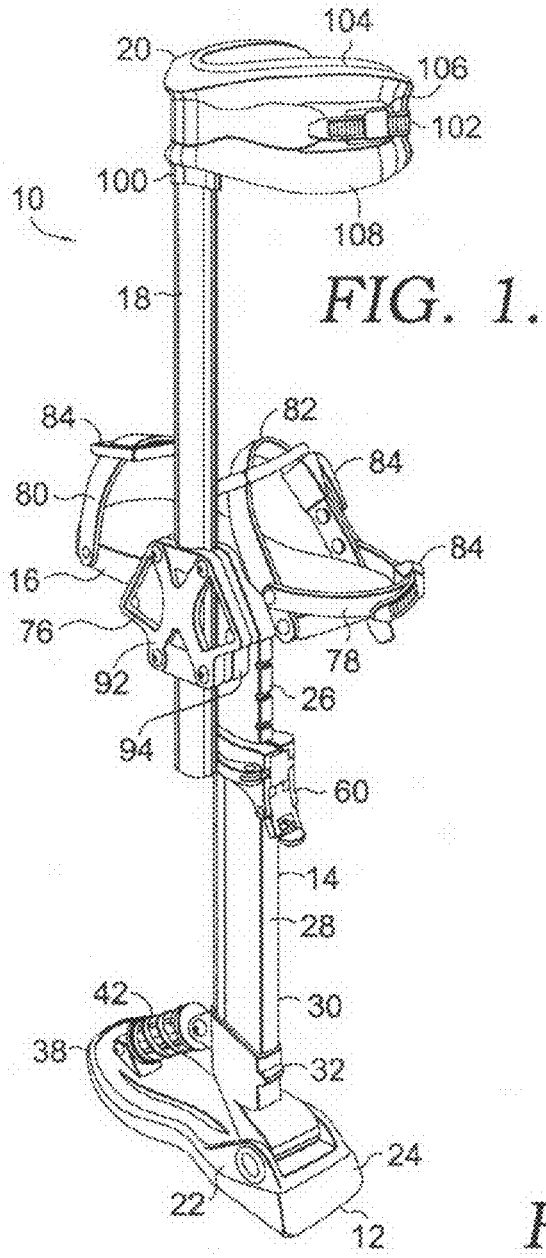
FIG. 1 is a perspective view of an industrial stilt in accordance with an embodiment of the present invention.

Referring now to the drawings in detail, and initially to FIG. 1, numeral 10 generally designates one embodiment of an industrial stilt of the present invention. Stilt 10 generally comprises a floor-engaging member 12, a load-bearing riser 14, a foot-engaging member 16, a leg support member 18 and a leg/calf cuff assembly 20. Industrial stilt 10 may be shipped and received by the user as a fully-assembled unit, or may be shipped and received by the user in separate, individual, unassembled components for later assembly by the user.

Figure 2:
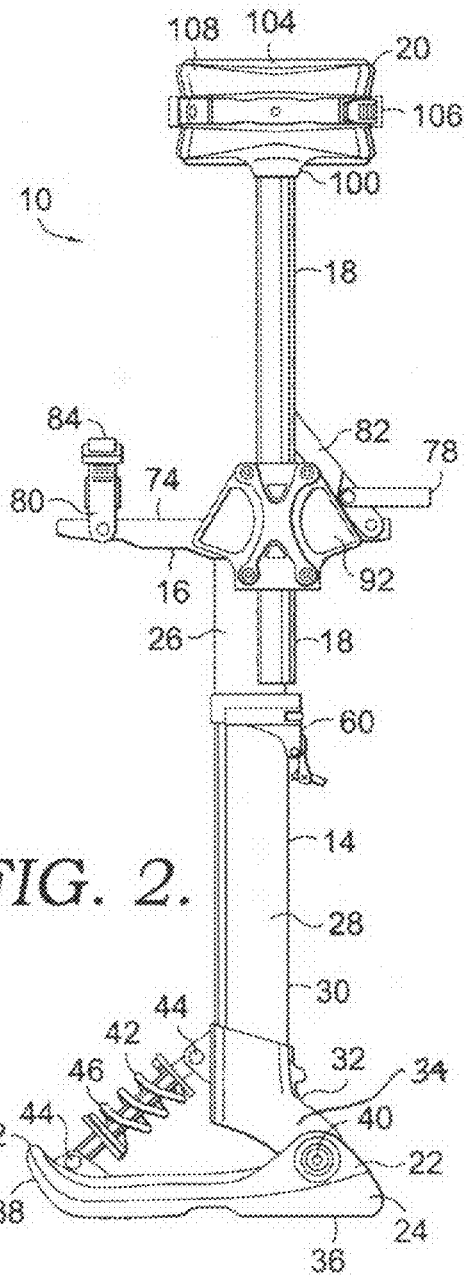
FIG. 2 is a left side elevation view of an industrial stilt in accordance with an embodiment of the present invention.

As seen in FIGS. 1 and 2, floor-engaging member 12 may include a substantially rigid base 22 and an outsole 24. Base 22 may be formed of a relatively hard, rigid material such as aluminum or plastic, while outsole 24 may be formed of a relatively soft and pliable but durable polymer, rubber, or other suitable material. Outsole 24 is affixed to and over the bottom portion of the substantially rigid base 22 by overmolding or other means well known to those of ordinary skill in the art. As best seen in FIG. 2, in one embodiment, the toe portion of floor-engaging member 12 and outsole 24 turn upwardly to aid in the overall motion of the user's foot and to reduce the likelihood that a user will trip on debris or on an irregular or uneven floor surface. The outsole 24 provides traction between the floor or ground and the stilt 10 and also enhances the comfort of the user by providing a cushioned impact surface. The bottom surface of the outsole 24 may be treaded or textured to further enhance traction, and it will be understood that different shapes, sizes, materials, and configurations of base 22 and outsole 24 may be utilized depending upon the primary benefits and performance desired.

As seen in FIGS. 1 and 2, a load-bearing riser 14 is coupled between and to floor-engaging member 12 and foot-engaging member 16. Load-bearing riser 14 generally comprises an upper riser portion 26 in telescoping or sliding relation with a lower, fixed riser portion 28. Upper riser portion 26 may telescope and be received in lower riser portion 28, as depicted in FIGS. 1 and 2. Conversely, those of skill in the art will recognize that lower riser portion 28 may telescope and be received in upper riser portion 26. Both upper riser portion 26 and lower riser portion 28 are rigid, generally tubular, oval-shaped, or D-shaped in cross-section, and may be formed of aluminum, magnesium alloy, plastic, carbon- or fiber-reinforced polymer, or other rigid but relatively lightweight materials known to those of ordinary skill in the art of sufficient strength and rigidity to support the weight of the user and other loads (e.g., drywall, plywood, tools, etc.) imposed on the stilt 10 during use. It will be understood by those of ordinary skill in the art that other cross-sectional shapes, sizes, and materials of load-bearing riser 14, upper riser portion 26, and lower riser portion 28 may be employed depending upon the primary benefits and performance desired. It also will be understood that lower riser portion 28 may be formed as a single, unitary member (not depicted) or, as seen in FIG. 2, lower riser portion 28 may further comprise a first lower riser member 30 rigidly coupled with a second lower riser member 32. In one embodiment, first lower riser member 30 is constructed of aluminum and is rigidly coupled with second lower riser member 32 constructed of rigid plastic.

As best seen in FIG. 2, when the load-bearing riser 14 is in a substantially vertical, upright position, the majority of the load-bearing riser 14 is perpendicular to floor-engaging member 12. At or near the lower end of the load-bearing riser 14, the lower riser portion 28 descends at an angle to provide an angle member 34 which is pivotally coupled at or near its lower end with a heel portion 36 of floor-engaging member 12 by an axle 40, bolt, pin, shaft, or other means well known to those of ordinary skill in the art. When the load-bearing riser 14 is in a substantially vertical, upright position, the angle member 34 and the floor-engaging member 12 form an acute angle at the axle 40 with a space between the angle member 34 and the floor-engaging member 12 so that the angle member 34 can move without obstruction during movement. Lower riser portion 28 also is coupled with a toe portion 38 of floor-engaging member 12 via a biasing assembly 42. As seen in FIGS. 1 and 2, biasing assembly 42 is pivotally attached to and between lower riser portion 28 and toe portion 38 by pins 44, bolts, axles, or other means well known to those of ordinary skill in the art.

Figure 3:
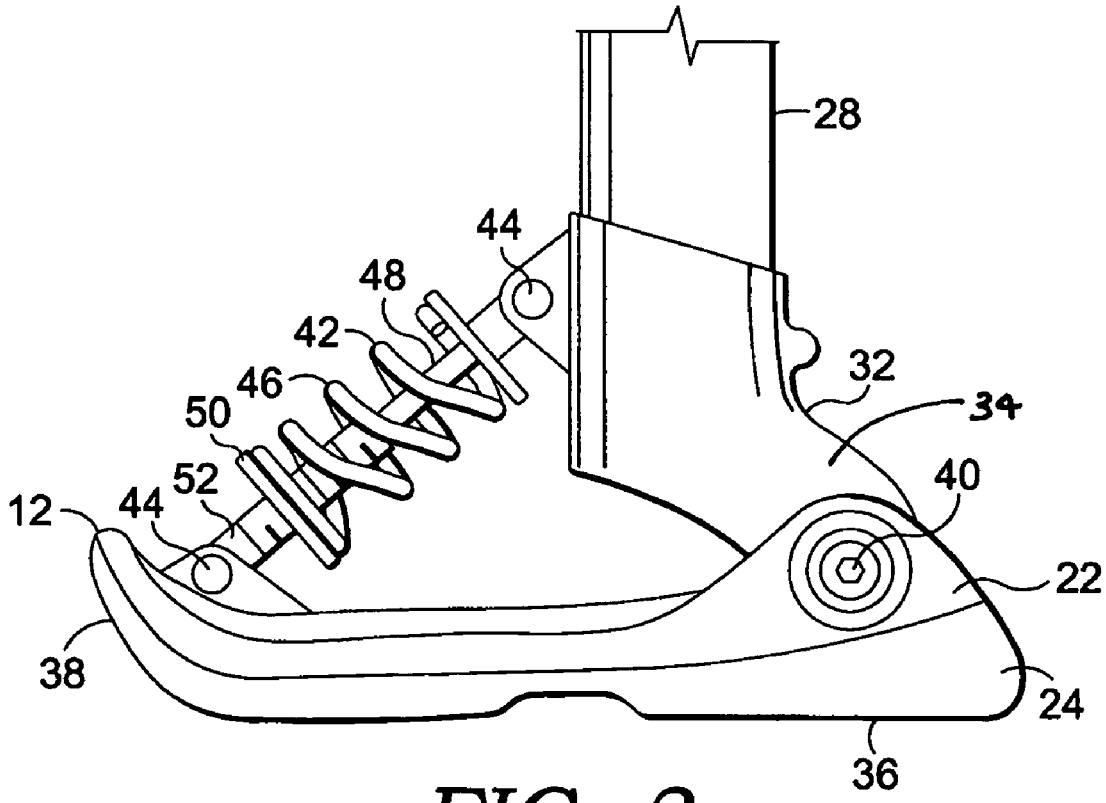
FIG. 3 is a detailed portion of a left side elevation view of an industrial stilt in accordance with and embodiment of the present invention.

In one embodiment, as best seen in FIG. 3, biasing assembly 42 comprises a spring assembly 46, a compression piston and rod assembly 48, and a spring tension adjustment knob 50. The biasing assembly 42 extends at an angle between lower riser portion 28 and toe portion 38. Referring again to FIG. 2, it is seen that the inner diameter of spring assembly 46 is sufficiently large to enable the spring assembly 46 to surround compression piston and rod assembly 48 in coaxial relationship. Internal threads are formed in spring tension adjustment knob 50 and mate with external threads formed on the outer surface of compression pistons 52. Spring tension adjustment knob 50 may be turned clockwise or counterclockwise to alter the compression and resistance of spring assembly 46 and thereby control the stilt's resistance to lean.

As best seen in FIG. 3, when load-bearing riser 14 is in a substantially vertical, upright position, compression piston 52 maintains an uncompressed state and spring assembly 46 is at its uncompressed, at-rest length. If the user of stilt 10 leans backward, spring assembly 46 prevents load-bearing riser 14 from undergoing excessive or unsafe backward lean and tends to maintain load-bearing riser 14 in a substantially vertical, upright position (i.e., substantially perpendicular to the floor surface). Backward lean is further minimized by the placement of load-bearing riser 14 forward of pivoting axle 40 as accomplished via the substantially L-shaped configuration of second lower riser member 32. As can be seen in FIGS. 2 and 3, forward lean of load-bearing riser 14 is resisted by compression of both compression piston and rod assembly 48 and spring assembly 46. The compression of spring assembly 46 and compression piston and rod assembly 48 resist forward lean and thereby serve to bias and maintain load-bearing riser 14 in a substantially vertical, upright orientation. It will be understood that the materials, lengths, diameters, and configurations of spring assembly 46 and compression piston and rod assembly 48 may be adjusted or selected to achieve the desired resistance to forward and/or backward lean and to optimize the performance of stilt 10. Is also will be understood that other biasing means known to those of ordinary skill in the art (e.g., elastic or compressible members, springs in coaxial and/or end-to-end relation, etc.) may be employed to resist forward and/or backward lean and to maintain load-bearing riser 14 in a substantially vertical, upright (and therefore relatively safe) orientation.

Figure 6:
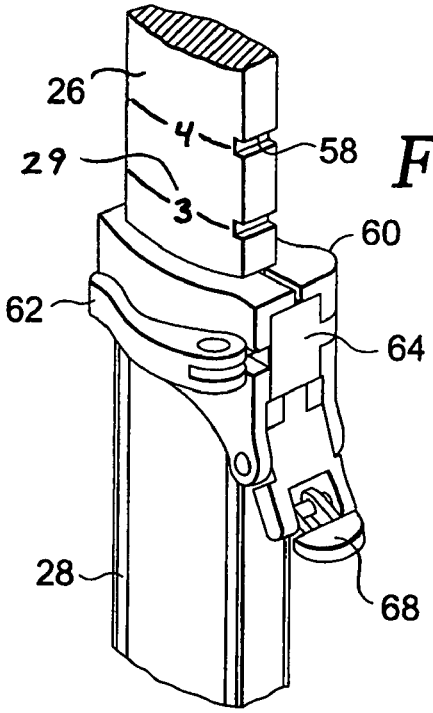
FIG. 6 is a fragmentary perspective view of the load-bearing riser and riser locking assembly in the locked/closed position in accordance with an embodiment of the present invention.
Figure 7:
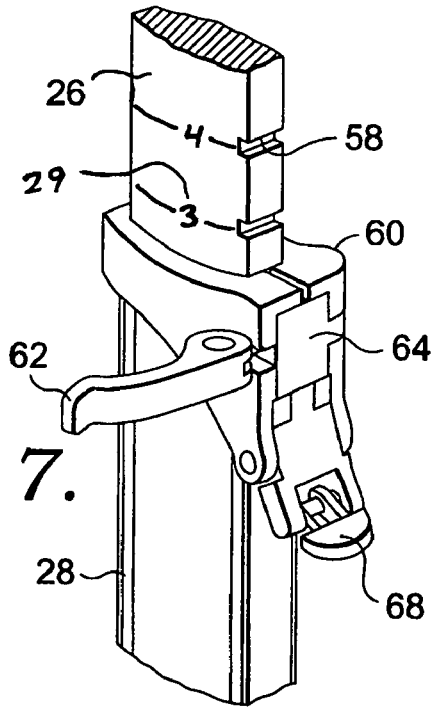
FIG. 7 is a fragmentary perspective view of the load-bearing riser and riser locking assembly with the safety lever in the partially open/unlocked position in accordance with an embodiment of the present invention.
Figure 8:
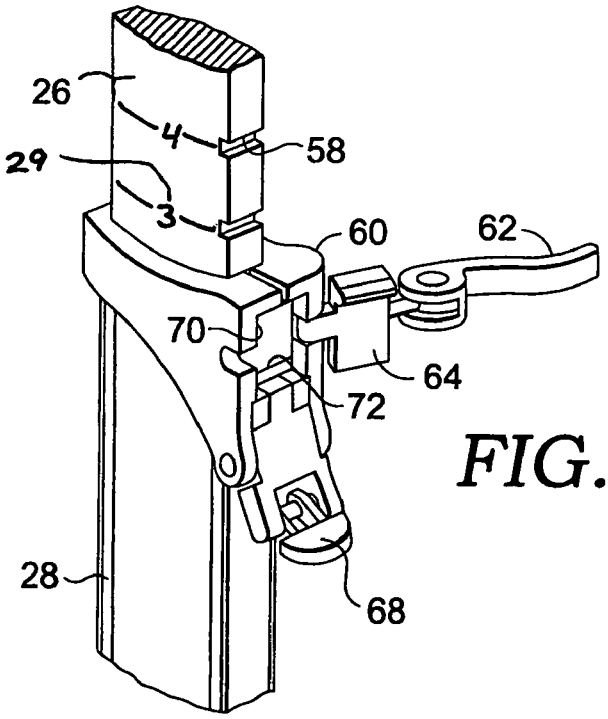
FIG. 8 is a fragmentary perspective view of the load-bearing riser and riser locking assembly with the safety lever in the fully open/unlocked position in accordance with an embodiment of the present invention.
Figure 9:
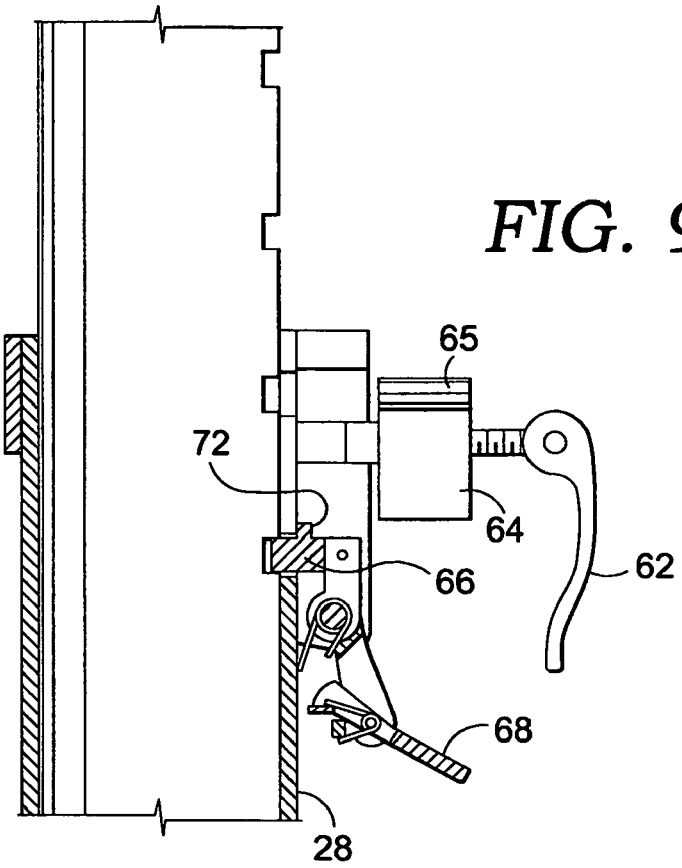
FIG. 9 is a fragmentary cross-sectional view of the load-bearing riser and riser locking assembly with the safety lever in the fully open/unlocked position and the release tab and notch engagement member in the engaged/locked position in accordance with an embodiment of the present invention.
Figure 10:
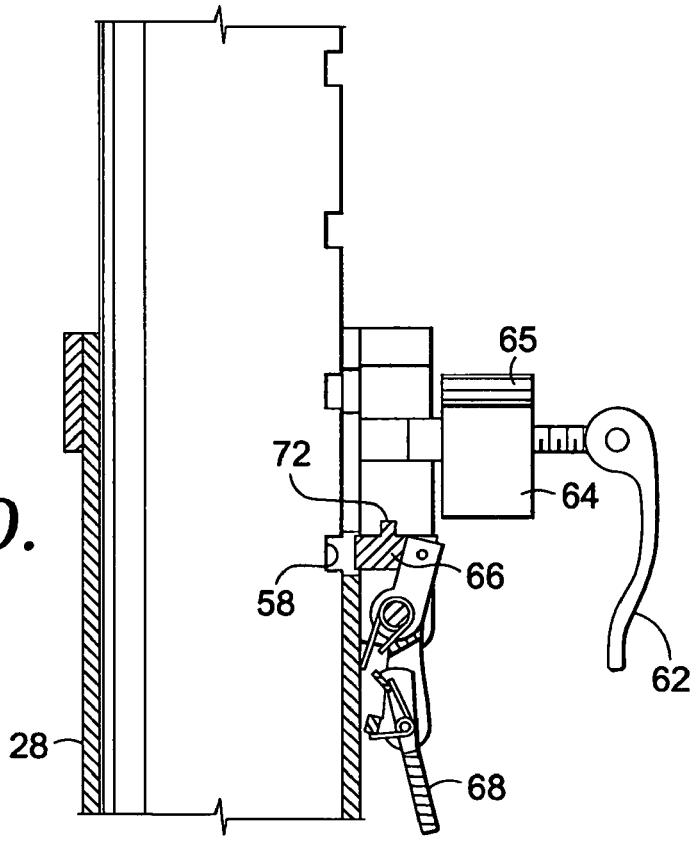
FIG. 10 is a fragmentary cross-sectional view of the load-bearing riser and riser locking assembly with the safety lever in the fully open/unlocked position and the release tab and notch engagement member in the disengaged/unlocked position in accordance with an embodiment of the present invention.

As previously noted and as best seen in FIGS. 1, 2 and 6-8, load-bearing riser 14 generally includes an upper riser portion 26 received in and in telescoping relation with a lower riser portion 28. Alternatively, lower riser portion 28 may telescope and be received in upper riser portion 26. As seen in FIGS. 1 and 2, the outer diameter or dimensions of upper riser portion 26 are sized such that upper riser portion 26 may be slidably received in lower riser portion 28, and a plurality of indentation or notches 58 are formed in upper riser portion 26. As best seen in FIGS. 6-10, a riser locking assembly 60 is coupled at or near the upper end of lower riser portion 28 and generally comprises a safety lever 62, a locking member 64 coupled with safety lever 62 and having a locking member tab 65, a notch engagement member 66, and a release tab 68 coupled with notch engagement member 66. It will be understood that for an embodiment of the invention in which lower riser portion 28 telescopes and is received in upper riser portion 26, riser locking assembly 60 may be coupled with the upper riser portion 26, and notches 58 may be formed in lower riser portion 28. Notch engagement member 66 engages a selected notch 58 such that the length of load-bearing riser 14 may be adjusted and safely fixed while the stilt 10 is in use. When the safety lever 62 and locking member 64 are in their locked/closed position, as seen in FIG. 6, locking member tab 65 (as seen in FIGS. 9 and 10) also engages a notch 58 to further ensure that load-bearing riser 14 remains fixed while the stilt 10 is in use. Notch engagement member 66 is spring biased to the engaged position, as best seen in FIG. 9, and may be disengaged from notch 58 by pressing release tab 68 toward lower riser portion 28, as best seen in FIG. 10. Notch engagement member 66 includes a safety tab 72, as best seen in FIGS. 9 and 10. After notch engagement member 66 is disengaged from notch 58, telescoping upper riser portion 26 may be slid upwardly or downwardly within lower riser portion 28 to obtain the desired length of load-bearing riser 14. The desired load-bearing riser 14 length (and therefore the user's elevation) may then be fixed and safely maintained during use by reengaging notch engagement member 66 within a corresponding notch 58. As seen in FIGS. 6-8, load bearing riser 14 may include or be marked with length indicia 29 (e.g., numerals and/or lines) to indicate to the user the general overall length/height of the load bearing riser 14 and stilt 10 and to help ensure that each of the stilts 10 being used (typically two stilts) has been adjusted to the same approximate length/height.

As best seen in FIGS. 6-8, safety lever 62 and locking member 64 prevent notch engagement member 66 from becoming accidentally disengaged from notch 58 while stilt 10 is in use. When stilt 10 is in use, as depicted in FIG. 6, notch engagement member 66 is engaged in notch 58, and safety tab 72 is covered and blocked by locking member 64 to safely maintain notch engagement member 66 in notch 58. Safety lever 62 prevents locking member 64 to safely maintain notch engagement member 66 in notch 58. Safety lever 62 prevents locking member 64 from accidental release while stilt 10 is in use. Notch engagement member 66 may only be disengaged from notch 58 by first releasing safety lever 62 by pivoting the safety lever 62 outwardly away from lower riser portion 28, as seen in FIG. 7. After safety lever 62 has been released, safety lever 62 may be pulled or further pivoted away from lower riser portion 28 to thereby remove locking member 64 from the corresponding aperture 70 formed in riser locking assembly 60 and to uncover and expose safety tab 72, as seen in FIG. 8. Notch engagement member 66, which is spring biased to maintain a normally-engaged position, may then be disengaged from notch 58 by depressing release tab 68. Pivotal movement of safety lever 62 and locking member 64 is sufficient to allow for disengagement of notch 58, thereby permitting vertical movement of upper riser portion 26 relative to lower riser portion 28. However, the amount of pivotal movement by lever 62 and locking member 64 is limited so as to prevent the lever and locking member from being positioned in the area underneath leg support member 18. Such an arrangement prevents damage to lever 62 and locking member 64 should an unintentional collapse of leg support member 18 occur.

Figure 4:
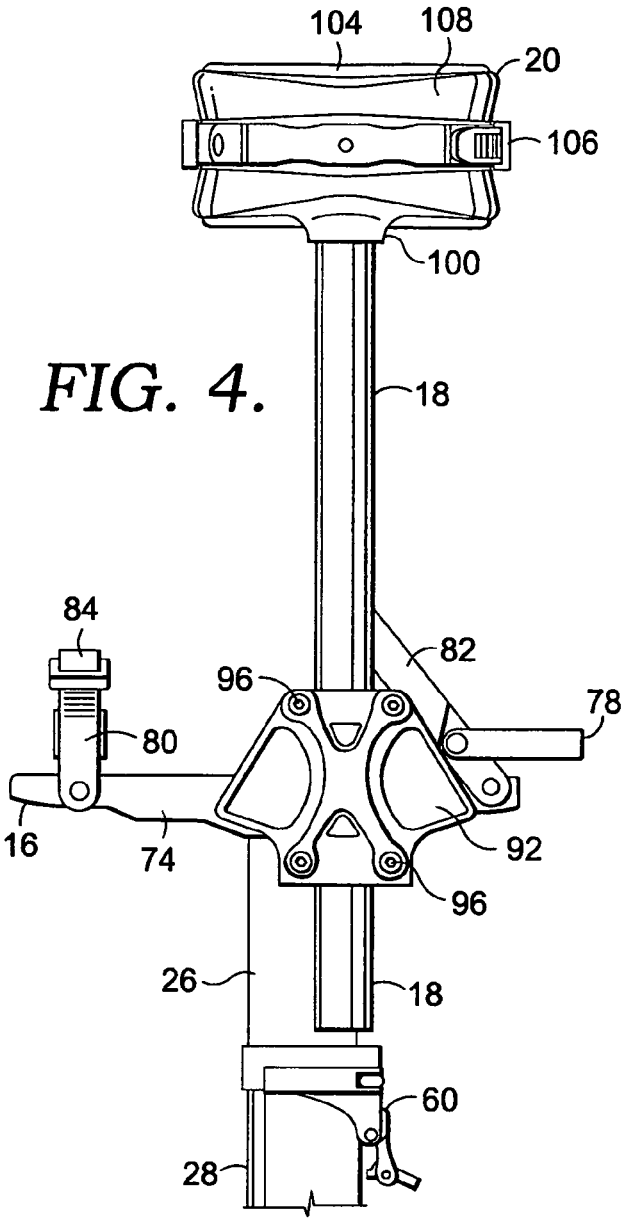
FIG. 4 is a left side elevation view of the upper portion of an industrial stilt in accordance with an embodiment of the present invention.
Figure 5:
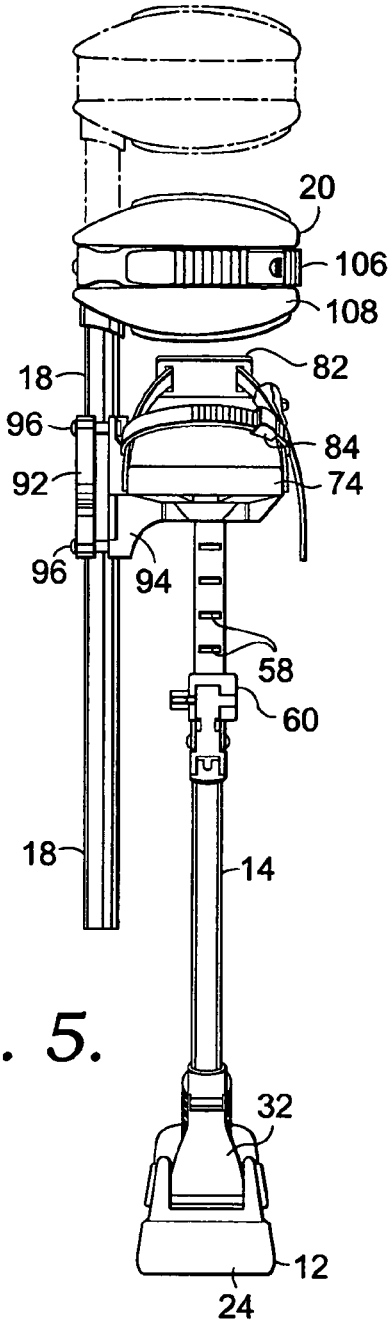
FIG. 5 is a rear elevation view of an industrial stilt in accordance with an embodiment of the present invention.

Referring back to FIG. 4, the upper end of telescoping upper riser portion 26 is fixed to the bottom surface of foot-engaging member 16. Foot-engaging member 16 may be constructed of aluminum, polymer, or other material of suitable rigidity and strength and is provided with an orifice (not shown) formed in the bottom surface of foot-engaging member 16 in which the upper riser portion 26 is received and secured by bolts, welding, adhesive, or other attachment means well known to those of ordinary skill in the art. As best seen in FIGS. 1, 4, and 5, foot-engaging member 16 generally comprises a rigid foot base 74, a leg support bracket assembly 76, a heel strap 78, a toe strap 80, and an arch strap 82. Heel strap 78, toe strap 80, and arch strap 82 are attached to foot base 74 to maintain the user's foot firmly on foot base 74 and prevent forward, backward, and sideways slippage of the user's foot while standing or walking. Arch strap 82 is applied over and about the arch of the user's foot. Similarly, heel strap 78 is applied about the heel of the user's foot, and toe strap 80 is applied over and about the toe portion of the user's foot. As best seen in FIGS. 1, 4, and 5, straps 78, 80, and 82 are each provided with a ratchet buckle assembly 84 to permit the user to firmly but comfortably attach the stilt 10 to his or her foot and to quickly adjust and customize the fit. The ratchet buckle assemblies of toe strap 80 and arch strap 82 remain generally on the top of the user's foot for enhanced access when the stilt 10 is in use. The ratchet buckle assemblies 84 are similar to those utilized for snowboard bindings and are well known to those of skill in the art.

As best seen in FIGS. 1-5, leg support member 18 is coupled at or near its lower end with foot base 74 via leg support bracket assembly 76. Leg support member 18 extends upwardly and generally along the outside of the user's calf to leg/calf cuff assembly 20. Leg support member 18 is rigid, generally tubular, oval-shaped, or D-shaped in cross section, and may be formed of aluminum, plastic, carbon- or fiber-reinforced polymer, or other rigid but relatively lightweight materials known to those of ordinary skill in the art.

The lower end of leg support member is slidably received in leg support bracket assembly 76, which comprises a first bracket half 92 and second bracket half 94 coupled together via bolts 96 or other coupling means well known to those of ordinary skill in the art. In one embodiment, as seen in FIGS. 1-5, second bracket half 94 is formed integrally with foot base 74. First bracket half 92 and second bracket half 94 define an aperture in which leg support member 18 is received. When bolts 96 are loosened, first bracket half 92 and second bracket half 94 may be slightly separated to allow leg support member 18 to be slid upwardly or downwardly by the user to thereby achieve the desired position of leg/calf cuff assembly 20 on the user's leg and enhance the comfort and safety of the user. When the desired position of the leg/calf cuff assembly 20 is achieved, bolts 96 are tightened, causing the first bracket half 92 and second bracket half 94 to be tightened about leg support member 18, thereby holding leg support member 18 firmly in place between bracket halves 92 and 94 by frictional/interfering contact. It will be understood that a locking assembly similar to riser locking assembly 60 may be used to couple leg support member 18 with foot-engaging member 16 or foot base 74 in lieu of the aforementioned two-piece leg support bracket assembly 76. In this embodiment, a locking assembly similar to riser locking assembly 60 could be coupled with the adjacent to foot-engaging member 16 or foot base 74, with leg support member 18 having notches formed therein (similar to notches 58) and being slidably received in the locking assembly.

As best seen in FIGS. 1-5, leg/calf cuff assembly 20 is coupled to the upper end of leg support member 18. The exterior of leg/calf cuff assembly 20 includes a joiner tube 100 sized for receipt of the upper end of leg support member 18. In one embodiment, leg support member 18 is coupled with leg/calf cuff assembly 20 via the frictional/interference fit between the interior surface of joiner tube 100 and the exterior surface of leg support member 18 and by bolts (not shown) extending through the joiner tube 100 and leg support member 18. As best seen in FIGS. 1 and 2, leg/calf cuff assembly 20 further includes a cuff strap 102, cuff pad 104, ratchet assembly 106, and cuff body 108. Cuff strap 102 extends slightly above and below cuff body 108 and prevents discomfort to the user when cuff body 108 is tightened about the user's calf or leg. Ratchet assembly 106 is employed to tighten the cuff strap 102 about the cuff body 108 and user's leg to thereby ensure a secure fit for users of varying leg sized. In one embodiment, a shin pad (not shown) is fitted to cuff strap 102 such that the user's leg is completely encircled by cuff pad 104 and the shin pad, for increased comfort.

In operation, a user places his or her foot on the upper surface of foot-engaging member 16 by sliding the foot under toe strap 80 and arch strap 82. Straps 80 and 82 are then tightened over the user's foot by ratchet buckle assemblies 84. The user then extends heel strap 78 across his or her heel and tightens the strap 78 across the heel using ratchet buckle assembly 84. The user then places cuff body 108 (and cuff pad 104) about his or her calf and tightens cuff strap 102 using ratchet assembly 106 until leg/calf assembly 20 is securely but comfortably fitted to the user's calf. The user can now stand on industrial stilt 10 at a desired elevated height. To obtain a desired elevated height, the user may adjust the length of load-bearing riser 14 as described above before attaching stilt 10 to his or her leg. The user also may adjust the position of the leg/calf cuff assembly 20 on his or her leg, also as described above.

When using stilt 10, the user may walk with a substantially normal gait. As the user leans forward while walking or standing, biasing assembly 42 permits slight forward lean of load-bearing riser 14 but generally maintains load-bearing riser 14 (and therefore the user) in a substantially vertical, upright position. During movement, the load-bearing riser moves from a first position with the load-bearing riser 14 in a substantially vertical position to either a forward second position with the load-bearing riser 14 angled towards the toe 38 or a backward second position with the load-bearing riser 14 angled towards the heel. Excessive rearward lean is prevented by resistance from biasing assembly 42 and by the placement of load bearing riser 14 forward of axle 40.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative manes of implementing the aforementioned improvements without departing from the scope of the present invention.

It will be understood that certain features and subcombinations are of utility and may be employed without reference to other features and subcominations and are contemplated within the scope of the claims. Not all steps listed in the various figures need be carried out in the specific order described.

What is claimed is:

1. A stilt used in pairs for elevating a user thereof comprising:

a floor-engaging member having a heel portion and a toe portion;

a foot-engaging member;

a single load-bearing riser fixably connected to said foot-engaging member, said single load-bearing riser comprising an upper end and a lower end thereby forming a length therebetween, said single load-bearing riser having an angle member;

said angle member having a first angle end and a second angle end, said first angle end pivotally coupled with said heel portion of said floor-engaging member at a position posterior to said load-bearing riser;

a single biasing assembly having a first biasing end and a second biasing end, said first biasing end of said single biasing assembly pivotally coupled with said second angle end of said single load-bearing riser and said second biasing end of said single biasing assembly pivotally coupled with said toe portion of said floor-engaging member, said biasing assembly extending at an angle from said single load-bearing riser to said toe portion of said floor-engaging member;

a leg support member coupled with said foot-engaging member; and a leg cuff assembly coupled with said leg support member.

2. The stilt of claim 1 wherein said floor-engaging member comprises a base and an outsole.

3. The stilt of claim 1 wherein said single load-bearing riser comprises an upper riser portion in telescoping relation with a lower riser portion.

4. The apparatus of claim 3, wherein said upper riser portion is received within said lower riser portion.

5. The stilt of claim 1 wherein said single biasing assembly comprises a piston and rod assembly.

6. The stilt of claim 5 wherein said single biasing assembly further comprises a spring assembly, said spring assembly and said piston and rod assembly in substantially coaxial relation.

7. The stilt of claim 1 wherein said single load-bearing riser is adapted to move from a first substantially perpendicular position in relation to said floor-engaging member to a second forward position with said single load-bearing riser angled towards said toe portion of said floor-engaging member.

8. The stilt of claim 1 further comprising a leg support bracket comprising an aperture slidably receiving said leg support member, whereby said user can adjust the position of said leg cuff assembly on said user's leg.

9. A stilt used in pairs for elevating a user thereof comprising:

a foot-engaging member;

a floor-engaging member comprising a heel portion and a toe portion;

a single load-bearing riser fixably connected to said foot-engaging member, said single load-bearing riser comprising:

an upper end and a lower end, thereby forming a length therebetween, an angle member having a first angle end and a second angle end, said first angle end pivotally coupled with said heel portion of said floor-engaging member at a position posterior to said load-bearing riser, a lower riser portion extending generally vertically from said lower end, an upper riser portion in telescoping relation with said lower riser portion, and, a locking assembly configured to move from an engaged position maintaining said load-bearing riser in a fixed position to a disengaged position telescoping movement of a riser portion;

a single biasing assembly having a first biasing end and a second biasing end, said first biasing end of said single biasing assembly pivotally coupled with said second angle end of said load-bearing riser, said second biasing end of said single biasing assembly pivotally coupled with said toe portion of said floor-engaging member;

a leg support member coupled with said foot-engaging member; and a leg cuff assembly coupled with said leg support member.

10. The stilt of claim 9 wherein said locking assembly comprises a safety lever;

a locking member coupled to said safety lever, said locking member having a locking member tab; and, a notch engagement member spring-biased to a release tab.

11. The stilt of claim 9 wherein said leg support member extends upwards and generally parallel to said single load bearing riser along the side of said user's calf from said foot-engaging member to said leg cuff assembly.

12. The stilt of claim 9, further comprising a strap configured to allow a user to releasably attach said leg cuff assembly to said user's leg and a leg support bracket comprising an aperture slidably receiving said leg support member, whereby said user can adjust the position of said leg cuff assembly on said user's leg.

13. An apparatus for elevating a user comprising:

a foot-engaging member;

a floor-engaging member having a heel portion and a toe portion;

a single load-bearing riser fixably connected to said foot-engaging member, said single load-bearing riser including an angle member having a first angle end and a second angle end, said first angle end pivotally connected to said heel portion of said floor-engaging member;

a leg support member coupled to said foot-engaging member and extending generally parallel to said single load-bearing riser, and having a leg cuff assembly coupled thereto;

a single biasing assembly having a first biasing end and a second biasing end, said first biasing end pivotally coupled with said toe portion of said floor-engaging member and said second biasing end pivotally connected to said second angle end of said single load-bearing riser; and, a locking assembly configured to move from an engaged position maintaining said single load-bearing riser in a fixed position to a disengaged position, thereby allowing adjustment of said length of said single load-bearing riser.

14. The apparatus of claim 13 wherein said single load-bearing riser comprises a lower riser portion and an upper riser portion in telescoping relation with said lower riser portion.

15. The apparatus of claim 14, wherein said upper riser portion is received within said upper riser portion.

16. The apparatus of claim 13 wherein said locking assembly comprises:

a safety lever;

a locking member coupled to said safety lever, said locking member having a locking member tab; and, a notch engagement member spring-biased to a release tab.

* * * * *